US006035483A

United States Patent [19]

Gasparrini et al.

[11] Patent Number: 6,035,483

[45] Date of Patent: Mar. 14, 2000

[54] CLEANING SYSTEM AND PROCESS FOR MAKING AND USING SAME EMPLOYING A HIGHLY VISCOUS SOLVENT

[75] Inventors: C. Robert Gasparrini, Port Chester, N.Y.; Akira Hara, Tokyo, Japan; Walter H. Cano, Bridgeport, Conn.

[73] Assignee: Baldwin Graphic Systems, Inc., Stamford, Conn.

[21] Appl. No.: 08/476,382

[22] Filed: Jun. 7, 1995

[51] Int. Cl.[7] ..... B05C 9/12

[52] U.S. Cl. ..... 15/256.51; 15/256.63; 15/DIG. 12

[58] Field of Search ..... 15/256.5, 256.51, 15/256.52, 256.53, DIG. 12; 101/425

[56] References Cited

U.S. PATENT DOCUMENTS

| | | | |
|---|---|---|---|
| 2,189,556 | 2/1940 | Younghusband . | |
| 3,014,579 | 12/1961 | Lathrop . | |
| 3,069,815 | 12/1962 | Valentine | 15/DIG. 12 |
| 3,669,255 | 6/1972 | Raymus . | |
| 3,850,294 | 11/1974 | Phillips et al. . | |
| 3,941,558 | 3/1976 | Takiguchi | 15/256.52 |
| 3,980,176 | 9/1976 | Boggs . | |
| 4,064,061 | 12/1977 | Henry | 15/104.93 |
| 4,135,448 | 1/1979 | Moestue . | |
| 4,295,563 | 10/1981 | Becker et al. . | |
| 4,344,361 | 8/1982 | MacPhee et al. . | |
| 4,467,916 | 8/1984 | Hedden et al. . | |
| 4,673,523 | 6/1987 | Smith et al. | 15/104.93 |
| 4,678,724 | 7/1987 | Inagabi . | |
| 4,757,763 | 7/1988 | MacPhee et al. . | |
| 4,934,391 | 6/1990 | Futch et al. . | |
| 4,981,078 | 1/1991 | Dettinger et al. | 101/425 |
| 4,986,182 | 1/1991 | Sawaguchi et al. . | |
| 4,998,984 | 3/1991 | McClendon . | |
| 5,009,716 | 4/1991 | Gerson . | |
| 5,012,739 | 5/1991 | Loos et al. . | |
| 5,069,128 | 12/1991 | Hara et al. | 15/256.51 |
| 5,104,567 | 4/1992 | Staehr . | |
| 5,125,342 | 6/1992 | Hara . | |
| 5,143,639 | 9/1992 | Krawack . | |
| 5,168,314 | 12/1992 | Gunji et al. | 15/256.51 |
| 5,176,080 | 1/1993 | Gasparrini et al. . | |
| 5,188,754 | 2/1993 | Weltman et al. . | |
| 5,194,173 | 3/1993 | Folkard et al. . | |
| 5,207,160 | 5/1993 | Harada . | |
| 5,275,104 | 1/1994 | Corrado et al. | 15/256.53 |
| 5,320,217 | 6/1994 | Lenarz . | |
| 5,368,157 | 11/1994 | Gasparrini et al. . | |

FOREIGN PATENT DOCUMENTS

| | | |
|---|---|---|
| 390707 | 10/1990 | European Pat. Off. . |
| 2205559 | 5/1974 | France . |
| 2004511 | 8/1971 | Germany . |
| 2804801 | 8/1979 | Germany . |
| 3736397 | 5/1989 | Germany . |
| 3907611 | 9/1990 | Germany . |
| 2081181 | 2/1982 | United Kingdom . |

*Primary Examiner*—James F. Hook
*Attorney, Agent, or Firm*—Morgan & Finnegan, LLP

[57] ABSTRACT

A cleaning system employing a highly viscous cleaning agent. A highly viscous cleaning agent is placed on a strip of cleaning fabric whereby the strip of cleaning fabric is made functional for cleaning cylinders of printing presses. The strip of cleaning fabric is wrapped around the center piece. The strip of cleaning fabric may then be brought into contact with a cylinder to be cleaned in order to clean the cylinder. The highly viscous cleaning agent may be made by mixing a viscosity adding agent with a low volatility, organic compound solvent. Additionally, water or another additive may be mixed in for improved cleaning properties. The method of making the same is also discussed.

23 Claims, 5 Drawing Sheets

CLEANING SYSTEM AND PROCESS FOR MAKING AND USING SAME EMPLOYING A HIGHLY VISCOUS SOLVENT

FIELD OF THE INVENTION

This invention relates to a cleaning system employing a strip of cleaning fabric wrapped around a core or a shaft to form a cleaning fabric supply roll. A highly viscous solvent is placed on the strip of cleaning fabric whereby said strip of cleaning fabric is functional for cleaning the cylinders of printing presses.

BACKGROUND OF THE INVENTION

A wide variety of cleaning systems and apparatus employing the same to clean the cylinders of printing presses are known. Typical blanket cleaning systems and apparatus employing the same, including cleaning blankets and cleaning solutions, are exemplified by U.S. Pat. No. 4,135,448 to Moestue which is directed to a mechanism for cleaning a cylinder that is provided with a cleaning cloth which is wetted with a cleaning fluid or solution prior to its encountering the pressure roller; U.S. Pat. No. 4,934,391 to Futch et al. is directed to a composition for ink removal that exhibits a low vapor pressure and which is a low vapor pressure organic compound; U.S. Pat. No. 4,986,182 to Sawaguchi et al. is directed to a cleaning apparatus in which a cleaning cloth is dampened by a liquid; U.S. Pat. No. 5,009,716 to Gerson is directed to a wash for removing ink comprising a low volatile organic compound; U.S. Pat. No. 5,012,739 to Loos is directed to a washing device comprising a cleaning cloth dampened with a washing medium and U.S. Pat. No. 5,069,128 to Hara is directed to a device for cleaning a cylinder of a printing machine comprising a cleaning cloth impregnated with a cleaning liquid.

In addition, U.S. Pat. No. 5,104,567 to Staehr is directed to a liquid for cleaning ink from printing machines; U.S. Pat. No. 5,125,342 to Hara is directed to a method for cleaning the cylinder of a printing machine; and U.S. Pat. No. 5,143,639 to Krawack is directed to a cloth moistened with a low vapor pressure cleaning agent for removing ink; whereas U.S. Pat. No. 5,188,754 to Weltman et al. is directed to a cloth soaked with a cleaning formula and U.S. Pat. No. 5,194,173 to Folkard et al. is directed to a method for removing ink from printing machines. Still further, U.S. Pat. Nos. 4,344,361 and 4,757,763 to MacPhee et al. is directed to automatic blanket cylinder cleaners provided with cleaner fabrics adapted to contact the blanket cylinders of printing presses. On the other hand, U.S. Pat. No. 5,175,080 to Gasparrini et al. is directed to a cloth supply system for the blanket cylinder for use in printing presses.

While the above-mentioned patents accomplish their purposes to a satisfactory extent, they still exhibit a variety of drawbacks. For example, they usually require apparatus, such as pumps, spray bars, manifold lines, valves, and the like as part of the automatic blanket cleaning systems for introducing the cleaning solvents or solutions to the cleaning fabric just prior to actual use.

U.S. Pat. No. 5,368,157 to Gasparrini et al., the present applicants, attempted to overcome these problems. That patent is directed to a pre-packaged, pre-soaked cleaning system for use with printing machines or the like to clean the cylinders of such machines and which comprises a pre-soaked fabric roll saturated to functional equilibrium with low volatility organic compound solvent and which is disposed around an elongated, cylindrical core and a sealed or a shrunken and sealed plastic sleeve disposed around and in contact with the fabric roll, whereby the pre-soaked saturated roll can be transported and stored vertically and/or horizontally until use without substantially disturbing the distribution of the solvent in the fabric roll and detrimentally effecting the cleaning ability of the fabric. The low volatility, organic compound solvent used is typically selected from vegetable oils and citrus oils and the like. These solvents have a low viscosity so that the solvents are Newtonian fluids.

While the invention disclosed in U.S. Pat. No. 5,368,157 works well for its intended purpose, improvements have been discovered. When the patented product is placed in the vertical position, the solvent shifts slightly downward in the evacuated package. When the package is restored to the horizontal position, the solvent migrates back towards equilibrium in the roll. This migration is caused by air pockets in the fabric of the roll.

Improvements have been developed and are embodied in patent applications commonly assigned to assignee. These improvements include the use of a strip of cleaning fabric having a reduced air content as described in U.S. patent application Ser. No. 08/431,799, entitled CLEANING SYSTEM AND PROCESS FOR MAKING SAME EMPLOYING REDUCED AIR CLEANING FABRIC. An alternate improvement involves saturating the strip of cleaning fabric with a low volatility solvent on site or on the press, as described in U.S. patent application Ser. No. 08/431,932 entitled SOAK ON SITE AND SOAK ON PRESS CLEANING SYSTEM AND METHOD OF USING SAME.

There still exists, however, a need for providing a cylinder cleaning system which improves upon the above-mentioned conditions and does not require the strip of cleaning fabric to be saturated with a low volatility, organic compound liquid solvent. The present invention fulfills such a need.

The foregoing specific objects and advantages of the invention are illustrative of those which can be achieved by the present invention and are not intended to be exhaustive or limiting of the possible advantages which may be realized. Thus, these and other objects of the invention will be apparent from the description herein or can be learned from practicing the invention, both as embodied herein or as modified in view of any variations which may be apparent to those of ordinary skill in the art, the same being realized and attained by means of parts, constructions, instrumentations, methods and combinations pointed out in the claims. The present invention resides in the novel parts, constructions, arrangements, combinations, methods and improvements herein shown and described.

OBJECTS OF THE INVENTION

It is therefore an object of the invention to provide a new and improved device for cleaning cylinders of printing presses.

It is a further object of the invention to provide a new and improved system for cleaning cylinders of printing presses which overcomes the drawbacks discussed above.

Another object of the invention is to provide a new and improved method for obtaining a strip of cleaning fabric which is functional for cleaning the cylinders of printing presses which allows transportation of the strip of cleaning fabric to the press without substantially disturbing the placement of the cleaning agent on the cleaning fabric and detrimentally affecting the cleaning ability of the strip of cleaning fabric.

It is still another object of the invention to provide a new and improved highly viscous cleaning agent for cleaning the cylinders of printing presses.

Yet another object of the invention is to provide a new and improved highly viscous cleaning agent for cleaning cylinders of printing presses which includes emulsified and retainable water.

Yet another object of the invention is to provide a new and improved highly viscous cleaning agent for cleaning the cylinders of printing presses which include an additive that has the cleaning effect of emulsifying and retaining water.

Another object of the invention is to provide a new and improved method for placing a highly viscous cleaning agent on a strip of cleaning fabric on a cylinder cleaning apparatus which is located on a press.

Yet another object of the invention is to provide a new and improved method for obtaining a highly viscous cleaning agent suitable for cleaning cylinders of printing presses.

Still another object of the invention is to provide a new and improved system for placing a cleaning agent on a strip of cleaning fabric so that the strip of cleaning fabric is functional to clean a cylinder of a press.

SUMMARY OF THE INVENTION

In accordance with the invention, there is provided a device for cleaning a cylinder of a printing press. The device includes a center piece, preferably either a shaft or a core. A strip of cleaning fabric is wrapped around the center piece to form a cleaning fabric supply roll. A highly viscous cleaning agent is present on the strip of cleaning fabric whereby, the strip of cleaning fabric is functional for cleaning cylinders of printing presses. Preferably, the highly viscous cleaning agent is in the form of a paste or a jell. In yet another embodiment, the highly viscous cleaning agent includes a water, surfactant, and cleaning agent mixture which is emulsified.

In a more specific embodiment, the device further includes a bag for enclosing the cleaning fabric supply roll.

In another more specific embodiment of the device, the highly viscous cleaning agent is present on substantially all of one side of the strip of cleaning fabric. Alternatively, the highly viscous cleaning agent may be placed on the strip of cleaning fabric in designs, such as horizontal stripes across the width of the strip of cleaning fabric or in diagonal stripes.

In a more specific embodiment of the invention, a reduced air content cleaning fabric is used.

In yet another more specific embodiment of the invention, the strip of cleaning fabric having the highly viscous cleaning agent placed upon it is positioned so that it may clean cylinders of printing presses.

The invention also includes a method for making a printing press cylinder cleaning system which includes applying a highly viscous cleaning agent to a strip of cleaning fabric so that the strip of cleaning fabric is functional for cleaning cylinders of printing presses. The strip of cleaning fabric is wrapped around a center piece to form a cleaning fabric supply roll.

In a more specific embodiment, the method also includes the step of unwinding the strip of cleaning fabric from a bulk roll prior to the application of the highly viscous cleaning agent.

In another more specific embodiment, the highly viscous cleaning agent is placed on substantially all of one side of the strip of cleaning fabric. Alternatively, only a portion of one side of the strip of cleaning fabric may be covered by the highly viscous cleaning agent. This partial covering may include horizontal stripes, diagonal stripes, a checkerboard pattern, or any other appropriate pattern.

In a preferred embodiment of the method, the highly viscous cleaning agent applied to the strip of cleaning fabric is either a jell or a paste. Additionally, it is preferable that the center piece that the strip of cleaning fabric is wrapped around is either a shaft or a core.

The invention also includes a device for applying a highly viscous cleaning agent to a strip of cleaning fabric. This device includes a means for mounting a bulk roll. The device also includes a means for applying a highly viscous cleaning agent to the strip of cleaning fabric and means for forming a cleaning fabric supply roll. A further embodiment of the invention includes a calendaring means for reducing the thickness and increasing the length of the strip of cleaning fabric on the second center piece without substantially increasing the diameter of said cleaning fabric supply roll.

In a more specific embodiment of the invention, the cleaning agent applying means includes at least a pair of rollers and a cleaning storage means for storing the highly viscous cleaning agent and for applying said cleaning agent to at least a pair of rollers.

The invention also comprises a device for applying a highly viscous cleaning agent to a strip of cleaning fabric including a mounting assembly. A bulk roll center piece is coupled to said mounting assembly to allow rotational movement of the bulk roll center piece. The strip of cleaning fabric is wrapped around the bulk roll center piece. The highly viscous cleaning agent is placed in a hopper having a hole. An applicator roller in contact with the strip of cleaning fabric and in association with the hopper to allow the solvent to flow through the hole and onto the applicator roller. The strip of cleaning fabric with the highly viscous cleaning agent is wound around the cleaning fabric supply roll center piece, the center piece rotatably coupled to the mounting assembly.

In a more specific embodiment of the device, the cleaning fabric supply roll is either a shaft or a core.

The invention also includes an assembly for use in a printing press cylinder system. This includes a cleaning fabric supply roll which includes a strip of cleaning fabric wrapped around a center piece. It also includes a highly viscous cleaning agent. The invention also comprises an applicator means for storing the highly viscous cleaning agent and for applying the highly viscous cleaning agent to the strip of cleaning fabric. A cylinder cleaning means is used to bring the strip of cleaning fabric after application of the highly viscous cleaning agent into contact with the cylinder to be cleaned and cleaning the cylinder. A take-up roll means is used to collect the used strip of cleaning fabric. Preferably, the highly viscous agent is either a jell or a paste.

In a more specific embodiment, the applicator means comprises at least one roller in contact with the strip of cleaning fabric and a means for storing the highly viscous cleaning agent and for dispensing said highly viscous cleaning agent to at least one roller.

An alternate embodiment of the invention embodied in an assembly for use in a printing press cylinder cleaning system includes a cleaning fabric supply roll including a strip of cleaning fabric wrapped around a center piece. A highly viscous cleaning agent is stored in a hopper and dispensed through the hopper. At least one roller is in contact with the strip of cleaning fabric and associated with the hopper to allow the highly viscous cleaning agent to flow through the dispenser and onto at least one roller and then onto the strip of cleaning fabric. A cylinder cleaning means is used to bring the strip of cleaning fabric into contact with the cylinder to be cleaned and cleaning the cylinder. A take-up means is used to collect the used strip of cleaning fabric.

An alternate embodiment of the assembly for use in a printing press cylinder cleaning system includes a cleaning fabric supply roll. The cleaning fabric supply roll includes a strip of cleaning fabric wrapped around a center piece. A highly viscous cleaning agent is stored in a hopper. A solvent applicator is in contact with the strip of cleaning fabric and operatively associated with the hopper for applying the highly viscous cleaning agent to said strip of cleaning fabric whereby the strip of cleaning fabric is made functional for cleaning cylinders of printing presses. A cylinder cleaning means is used to bring the strip of cleaning fabric into contact with the cylinder to be cleaned and cleaning the cylinder. A take-up roll means is used to collect the strip of cleaning fabric.

In a more specific embodiment, the assembly further includes a controller means for controlling the solvent applicator to apply the highly viscous cleaning agent in patterns.

It will be appreciated by those skilled in the art that the foregoing summary of the invention and the following detailed description are merely exemplary and explanatory of the present invention, but are not intended to be restrictive thereof or limiting of the advantages which can be achieved by the invention or various combinations thereof. The accompanying drawings referred to herein and constituting in part hereof, illustrate preferred embodiments of the invention and, together with the detailed description, serve to explain the principles of the invention.

BRIEF DESCRIPTION OF THE DRAWINGS

In order to understand the invention more fully, reference is directed to the accompanying drawings, which is to be taken in conjunction with the following description of the invention and in which drawing.

DESCRIPTION OF THE PREFERRED EMBODIMENTS

Figure 1A:
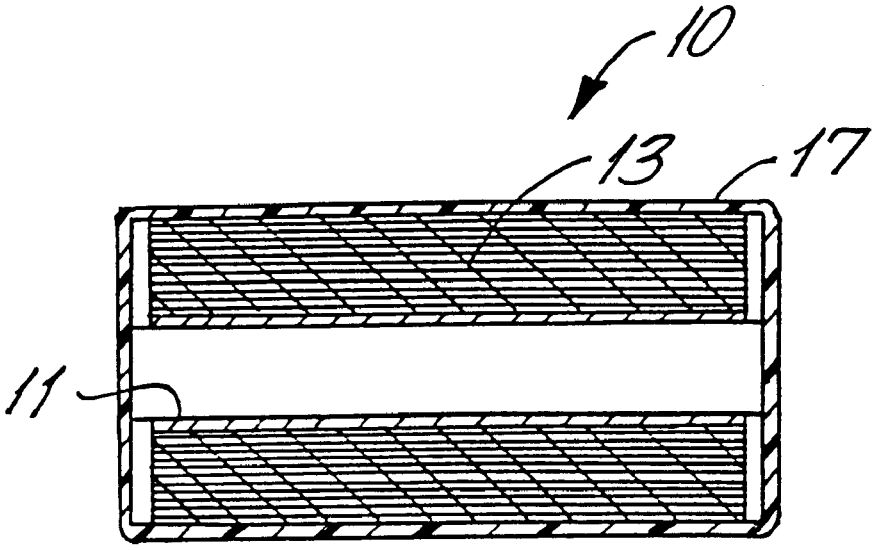
FIG. 1A is a lateral, sectional, elevational view of a cleaning fabric supply roll formed around a core.
Figure 1B:
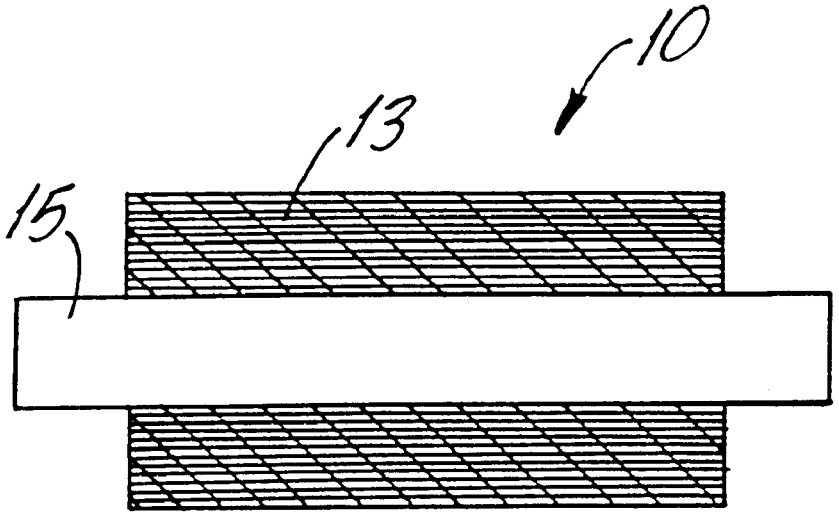
FIG. 1B is a lateral, sectional, elevational view of a cleaning fabric supply roll formed around a shaft.

Referring now to FIGS. 1A and 1B, a cleaning fabric supply roll 10 used with the present invention is shown. A strip of cleaning fabric 13 is wrapped around a center piece. The center piece may be, but is not limited, to a core 11 or a shaft 15. One embodiment of cleaning fabric supply roll 10, shown in FIG. 1A, comprises an elongated core 11 made from, for example, relatively heavy cardboard of sufficient strength so that it can support thereon a strip of cleaning fabric 13. Alternatively, if desired, the core 11 can be made from any other suitable material including, but not limited to, plastic or metal, such as steel, aluminum, and the like. Core 11 preferably has open ends to allow installation on an appropriate cylinder cleaning apparatus. Preferably, core 11 is completely hollow to allow a shaft, rod, or the like 15 to be inserted within the core 11 to provide installation in the cylinder cleaning apparatus. In such an embodiment, cleaning fabric supply roll 10 comprises core 11 and strip of cleaning fabric 13. In an alternate embodiment shown in FIG. 1B, cleaning fabric supply roll 10 is formed by winding the strip of cleaning fabric 13 directly around shaft 15.

Preferably, the core 11 and/or shaft 15 is cylindrical in shape. However, the core 11 and/or shaft 15 may be any other appropriate shape, such as having 3, 4, 5, or 6 sides or an oval. Such shapes are described in a patent application filed by applicant C. Robert Gasparrini on May 1, 1995 and entitled "MOUNTING MECHANISMS FOR CLOTH ROLLS ON PRESS CYLINDER CLEANING DEVICES", hereby incorporated by reference.

The strip of cleaning fabric 11 from which the cleaning fabric supply roll 10 is made may vary widely. For example, it may be made of paper, cloth, film, a mixture of wood pulp and polyester, such as DuPont SONTARA, or any other suitable material. In those cases where a cloth fabric is employed, it may be a woven or non-woven cloth fabric made of synthetic or natural fibers or mixtures of the same. Exemplative, but not limitative, of suitable synthetic fibers which may be used in the cloth fabrics are polyester fibers, rayon fibers, nylon fibers, and acrylic fibers and the like. Exemplative, but not limitative, of the natural fibers which may be employed are cotton fibers, wood pulp fiber, hemp fibers and the like.

In those cases where paper is employed as the fabric material, paper fabrics made from wood pulp modified chemically in accordance with paper manufacturing technology are suitable. It is preferred that the fabric employed be one which has a caliper thickness in a range from about 0.003 inches to about 0.030 inches, and preferably in a range from about 0.006 inches to about 0.020 inches.

In general, woven and non-woven fabrics suitable for use in carrying out the practice of the invention have a basic weight in a range of from about 1.5 ounces per square yard to about 6.0 ounces per square yard, a caliper thickness in the range mentioned above, a tensile strength in the longitudinal (machine) direction in a range of from about 20 lbs.

per inch to about 200 lbs. per inch and in a width (cross) direction in a range from about 15 lbs. per inch to about 125 lbs. per inch.

When paper is employed as a cleaning fabric in the system of this invention, it preferably has a basis weight in a range of from about 40 lbs. to about 90 lbs., a caliper thickness in a range of from about 0.003 inches to about 0.10 inches, a tensile strength in the longitudinal (machine) direction in a range of from about 20 lbs. per inch to about 80 lbs. per inch and in the width (cross) direction in a range of from about 15 lbs. per inch to about 50 lbs. per inch, and a stretch ability in a range of from about 1.0 percent to about 6.0 percent all determined by routine testing methods.

In order for the cleaning fabric supply roll 10 to be used to clean the cylinder, a highly viscous cleaning agent 20 must be placed on the strip of cleaning fabric 13 so that the strip of cleaning fabric 13 is functional for cleaning the cylinder 100. It is to be understood that "functional for cleaning" the cylinder 100 means that the strip of cleaning fabric 13 has sufficient highly viscous cleaning agent 20 on it that it imparts efficient cleaning ability to the fabric to clean cylinders of an apparatus, such as printing machinery.

A highly viscous cleaning agent is a cleaning agent being sufficiently viscous as to be a Non-Newtonian fluid. Any highly viscous cleaning agent capable of cleaning a cylinder of a printing press may be used. Alternatively, a low viscosity cleaning agent for purposes of this application is a cleaning agent which is a Newtonian fluid.

A suitable highly viscous cleaning agent may be made by taking a low volatility, organic compound solvent described in U.S. Pat. No. 5,368,157 to Gasparrini et al. entitled "PRE-PACKAGED, PRESOAKED CLEANING SYSTEM AND METHOD FOR MAKING THE SAME", herein incorporated by reference, and adding a viscosity adding additive, such as polyethylene glycol, until a highly viscous state is achieved. Preferably, this results in a highly viscous cleaning agent which is either a paste or a jell. Any other suitable viscosity adding additive can be used to create a highly viscous cleaning agent.

In an alternate embodiment of the highly viscous cleaning agent 20, it is preferred that water and a surfactant be added. The advantage of water is to clean paper coating and powder. Powder, usually starch, is used in two-sided offset printing to prevent pages from sticking to the other when they are placed on top of each other. To produce such a highly viscous cleaning agent, water is mixed with a surfactant. The water/surfactant mixture is then mixed with a low volatility organic compound solvent and a viscosity adding additive. The combined mixture is then emulsified, preferably by using a homogenizer or an ultra-sonic mixer. The end product should be stable enough to keep water for several months without separation of the water and the solvent. In an alternate embodiment, the surfactant and viscosity adding agent may be a single chemical, such as polyethylene glycol. This simplifies the procedure for making the highly viscous cleaning agent to, for example, mixing water, polyethylene glycol, and a low volatility organic compound solvent and emulsifying the mixture.

It is understood that any suitable additive may be used instead of water to form the cleaning agent. The additive replacing and having the same cleaning effect as emulsified and retained water.

Additionally, the emulsifying of a cleaning agent and water to create an more effective cleaning agent can be used with non-highly viscous cleaning agents, such as low viscosity cleaning agents. This can be achieved by first mixing water and a surfactant. The water/surfactant mixture is then mixed with, for example, a low viscosity cleaning agent such as a low volatility organic solvent. This mixture is then emulsified. This creates a low viscosity cleaning agent having a water/cleaning agent mixture with the advantage of being flowable. Such a mixture can be placed on a strip of cleaning fabric 13 and replace the low volatility organic compound solvents in cleaning systems and methods for making the same described in U.S. Pat. No. 5,368,157 and U.S. patent applications having Ser. Nos. 08/431,799 and 08/431,932.

The low volatility organic compound solvents described above vary widely and generally it would include at least one low volatility organic compound solvent which does not readily evaporate, as well as mixtures of the same with similar low volatile organic compound solvents or with normally volatile organic compound solvents. Exemplative, but not limitative, of suitable solvent materials of this type are organic compound solvents selected from vegetable oils and citrus oils and the like.

Figure 2A:
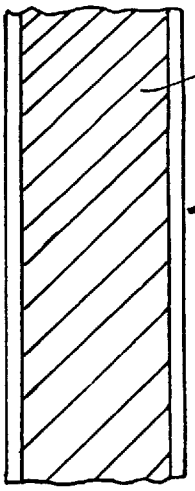
FIG. 2A is a view of a strip of cleaning fabric substantially covered with a highly viscous cleaning agent.
Figure 2B:
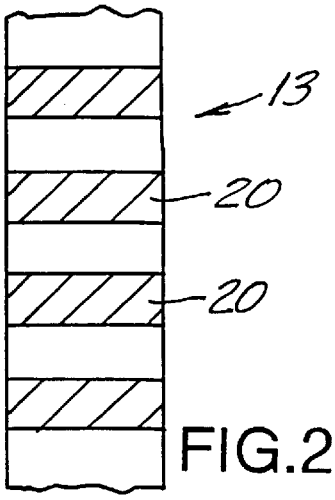
FIG. 2B is a view of a strip of cleaning fabric wherein the highly viscous cleaning agent is placed across the width of the strip of cleaning fabric in horizontal noncontiguous stripes.
Figure 2C:
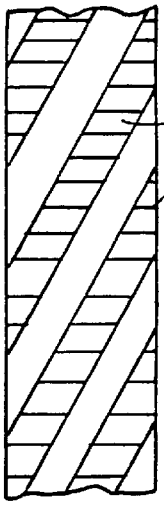
FIG. 2C is a view of a strip of cleaning fabric wherein the highly viscous cleaning agent is placed across the width of the strip of cleaning fabric in diagonal noncontiguous stripes across the width of the strip of cleaning fabric.
Figure 2D:
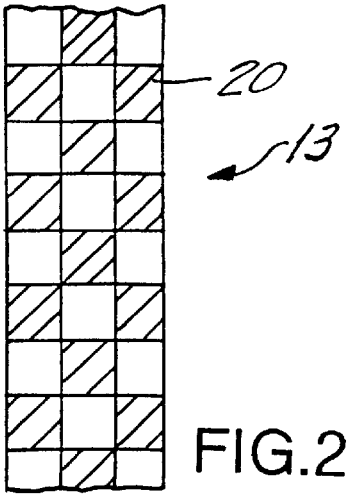
FIG. 2D is a view of a strip of cleaning fabric wherein the highly viscous cleaning agent is placed on the strip of cleaning fabric in a checkerboard pattern.
Figure 2E:
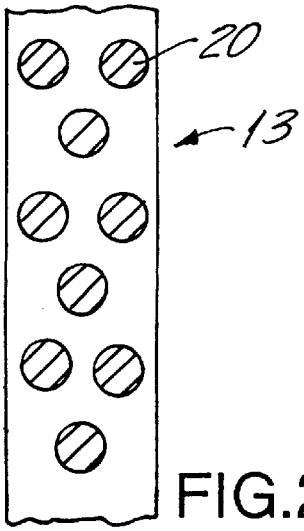
FIG. 2E is a view of a strip of cleaning fabric wherein the highly viscous cleaning agent is placed on the strip of cleaning fabric in a polka dot pattern.

Once the highly viscous cleaning agent 20 is obtained, it must be placed on the strip of cleaning fabric 13. Many patterns can be used. For example, as shown in FIG. 2A, the highly viscous cleaning agent 20 can be placed on all or substantially all of one side of the strip of cleaning fabric 13. Alternatively, other patterns can be used in which less highly viscous cleaning agent 20 is used in order to reduce cost. Examples are shown in FIG. 2B, substantially horizontal non-contiguous stripes of highly viscous cleaning agent 20 across the width of the strip of cleaning fabric 13; FIG. 2C, substantially diagonal stripes of the highly viscous cleaning agent 20 across the strip of cleaning fabric 13; FIG. 2D, the highly viscous cleaning agent 20 placed on the strip of cleaning fabric 13 in a checkerboard pattern; and FIG. 2E, the highly viscous cleaning agent 20 placed on the strip of cleaning fabric 13 in a polka dot pattern.

If desired, a bag or another container 17 may be placed around the cleaning fabric supply roll 10. An advantage of using a highly viscous cleaning agent instead of the solvents described in U.S. Pat. No. 5,368,157 is that even without a vacuum, the distribution of the highly viscous cleaning agent will remain intact and there will not be a significant change of the center of gravity of the cleaning fabric supply roll during storage. While vacuum storage is not required, it could be used to store the cleaning fabric supply roll.

Many methods exist for applying highly viscous cleaning agent 20 to the strip of cleaning fabric 13. In the simplest embodiment, highly viscous cleaning agent 20 is manually placed on the strip of cleaning fabric 13, such as by using a brush dipped into highly viscous cleaning agent 20.

Figure 4:
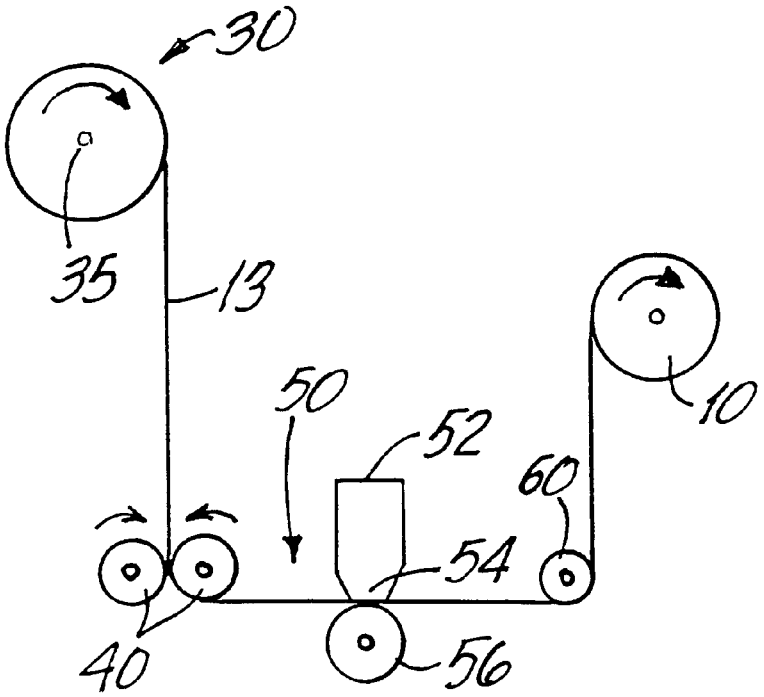
FIG. 4 is a cross-sectional view of a highly viscous cleaning agent application system.

An alternative embodiment of a method of presoaking a strip of cleaning fabric on site is shown in FIG. 4. A strip of cleaning fabric 13 is initially wound around a center piece 35, preferably a shaft or core, to form bulk roll 30. Bulk roll 30 may be rotatably mounted to a roll forming assembly. The amount of fabric on bulk roll 30 may be sufficient to form multiple cleaning fabric rolls 10. A portion of the strip of cleaning fabric 13 is unwound from bulk roll 30. If desired, at least a pair of calendaring rollers 40 may be used to calendar the strip of cleaning fabric 13. The at least a pair of calendaring rollers 40 compress the strip of cleaning fabric 13. Preferably, but not necessarily, the temperature of the at least a pair of rollers 40 is hotter than room temperature. Alternatively, the temperature of the at least a pair of rollers 40 is at about ambient temperature or less than ambient temperature. It has been found that the wettability and the distribution of the cleaning agent is very good in the calendarized fabric.

A surprising and unexpected result of the calendaring process is that the length of fabric is increased while not increasing the diameter of the cleaning fabric supply roll 10. This provides an important advantage because cleaners are designed to accept fabric rolls of up to a certain diameter. For example, one of the assignor's automatic blanket cleaners will only accept a cleaning fabric roll having a diameter of about 2.75 inches. Because of this extra length, a fabric roll of calendarized cloth will be usable for more washes than a regular fabric roll of the same fabric having the same diameter. This has two advantages. First, the cost per wash will be reduced. Second, the pressmen need not change a roll of cleaning fabric as often since there are more washes per roll of cloth. This will allow for the press to be run more often.

The amount of increase in the length of cloth due to calendaring is dependent on the fabric used and the amount of calendaring. For example when DuPont SONTARA cloth having a thickness of about 0.012 inches and a length of about 12 yards is placed about a core, having a diameter of about 1.5 inches, the fabric roll has a diameter of 2.75 inches. After being calendared the cloth has a thickness of about 0.0085 inches and a length of about 16 yards and still has a diameter of about 2.75 inches when placed on the same core. Thus, in this situation, calendaring results in an about 25% to about 30% increase in the length of the fabric without increasing the diameter of cleaning fabric supply roll 10. Depending on the type of fabric and amount of calendaring, results may range from about a 10% increase to about a 50% increase.

Calendaring fabric and its advantages are discussed in more detail in the U.S. patent application by C. Robert Gasparrini and Walter H. Cano entitled "CLEANING SYSTEM AND PROCESS FOR MAKING SAME EMPLOYING REDUCED AIR CLEANING FABRIC" filed May 1, 1995 and hereby incorporated by reference.

A cleaning agent application system 50 is used to apply a measured amount of highly viscous cleaning agent 20 to the strip of cleaning fabric 13. A hopper or container 52 is used to store cleaning agent 20. Hopper 52 has a hole, dispenser, or applicator 54. The highly viscous cleaning agent is removed from hopper 52 through hole, dispenser or applicator 54 onto strip of cleaning fabric 13. As shown, cleaning agent application system 50 also comprises a rotating roller 56 to hold the strip of cleaning fabric 13 in place as the highly viscous cleaning agent 20 is applied to the strip of cleaning fabric 13. While it is preferable to use a rotating roller 56, any other appropriate device, such as a non-rotating support member preferably having a low coefficient of friction, may be used. A roller 60, or any other appropriate device, may be used, if necessary, to change the direction the strip of cleaning fabric 13 is moving in through the assembly. An example of an alternate appropriate device is a curved piece of metal or plastic. The strip of cleaning fabric 13 with highly viscous cleaning agent 20 is then wound around a core, shaft or any other appropriate central piece to form a cleaning fabric supply roll 10. When a cleaning fabric supply roll 10 of an appropriate diameter is formed, the strip of cleaning fabric 13 is cut or torn, cleaning fabric supply roll 10 is removed, and a new shaft or core is used to form another cleaning fabric supply roll.

In the above described system, the winding of the strip of cleaning fabric 13 into a cleaning fabric supply roll 10 may cause the strip of cleaning fabric 13 to move through at least a pair of calendaring rollers 40 (if used) followed by a cleaning agent application system 56.

The cleaning agent application system 50 including all its elements, calendaring rollers 40, and cleaning fabric supply roll 10 may all be attached to a roll forming assembly.

Figure 5:
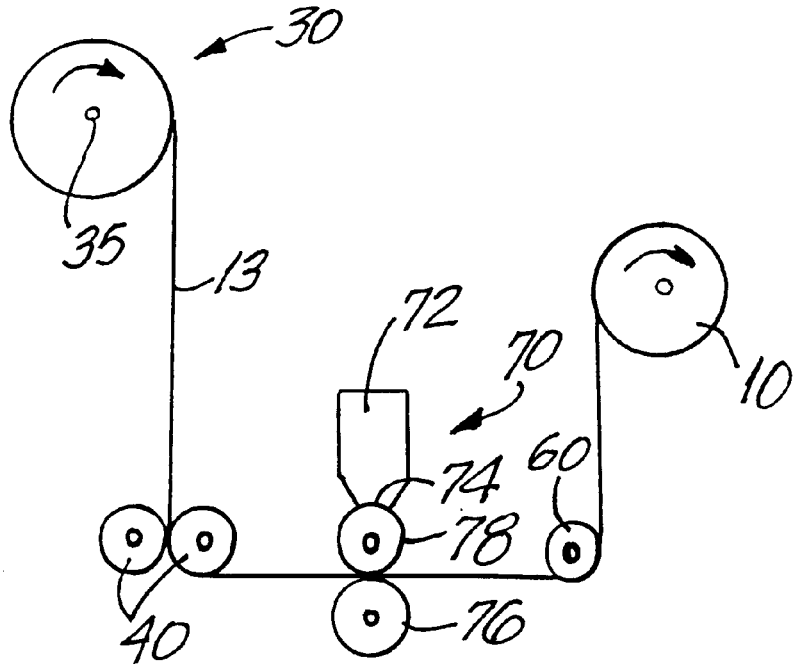
FIG. 5 is a cross-sectional view of an alternate embodiment of a highly viscous cleaning agent application system utilizing an application roller.

A system for applying a highly viscous cleaning agent 20 to a strip of cleaning fabric 13 using an alternate cleaning agent application system 70 is shown in FIG. 5. A hopper or container 72 having a hole or dispenser 74 is used to store the highly viscous cleaning agent 20. The highly viscous cleaning agent 20 is removed from the hopper 72 through hole or dispenser 74 and placed on applicator roller 78, which is associated with the hopper 72 such that cleaning agent will flow onto applicator roller 78. The applicator roller 78 is then used to apply the highly viscous cleaning agent 20 to the strip of cleaning fabric 13. As with the previously described embodiment, a rotating roller 76 or other appropriate supporting member is used to support the strip of cleaning fabric 13 while applicator roller 78 is used to apply the highly viscous cleaning agent 20.

It should be noted that the embodiments shown in FIGS. 4 and 5 do not need to have rolls 40 installed.

After having the highly viscous cleaning agent 20 applied to the strip of cleaning fabric 13 so that the strip of cleaning fabric 13 is functional for cleaning cylinders of printing presses, the cleaning fabric supply roll 10 having a strip of cleaning fabric 13 is then placed on a printing press having a cylinder 100 to be cleaned.

Figure 3:
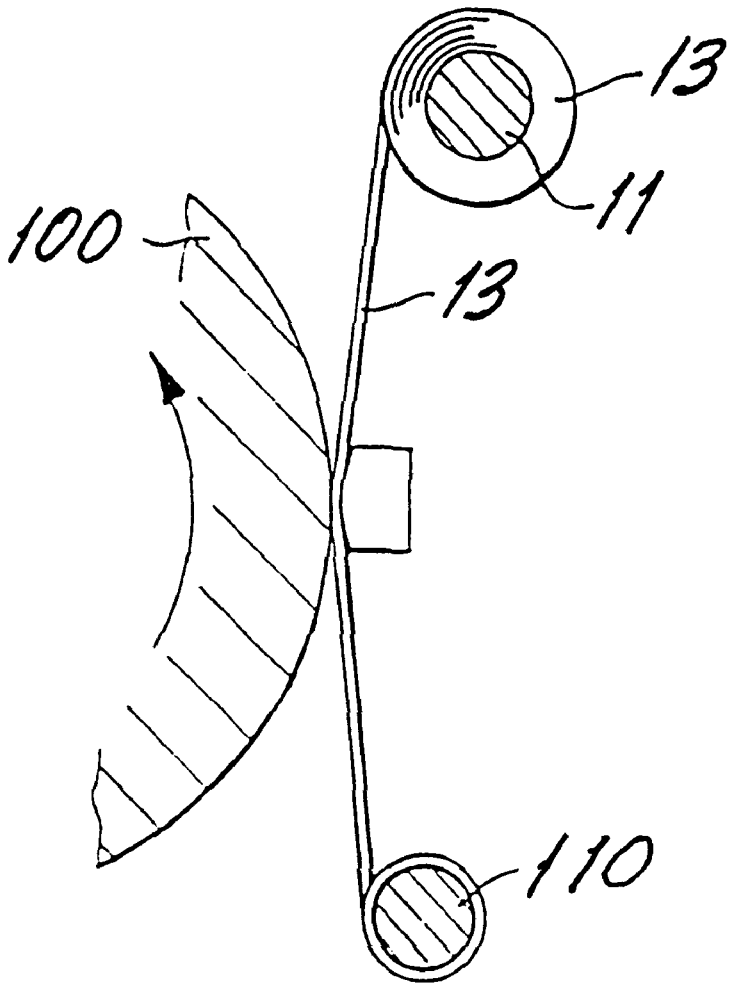
FIG. 3 is a partial cross-sectional view of a cylinder to be cleaned and a soaked on site cleaning system according to the present invention.

The printing press further includes a means for properly positioning the cleaning fabric to allow cleaning of the cylinder 100. Several ways exist for this result to be achieved. For example, the cleaning fabric 13 may be positioned so that it is adjacent the cylinder 100 to be cleaned. In another example, the cleaning fabric 13 may be adjacent to and operatively associated with the cylinder 100 to be cleaned. In yet another possible embodiment, the cleaning fabric 13 is operatively associated with the cylinder 100 to allow cleaning the cylinder 100 as the fabric 13 is fed past the cylinder 100. One possible arrangement is shown in FIG. 3. The person of ordinary skill in the art will be aware of many other configurations that will work for the invention's intended purpose without undue experimentation. These examples are merely exemplary and are not meant to limit how the invention may be used.

Figure 6:
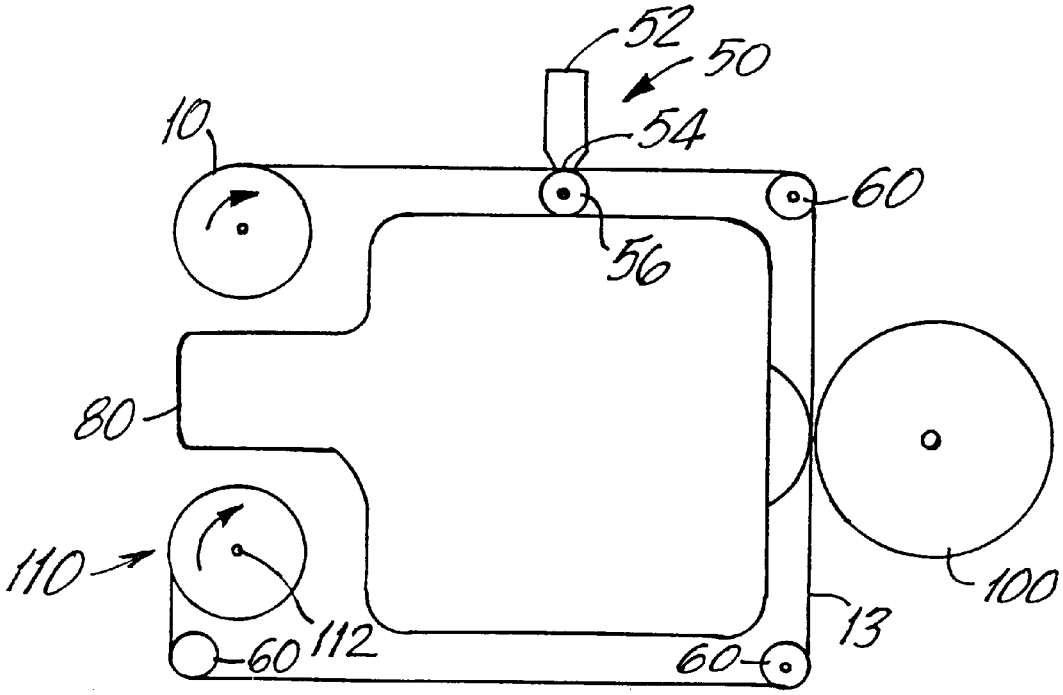
FIG. 6 is a cross-sectional view of an on press highly viscous cleaning agent application system.

An alternate method for applying the highly viscous cleaning agent 20 to the strip of cleaning fabric 13 involves using an assembly 1, as shown in FIG. 6, which is mounted on a printing press (not shown) to prepare a strip of cleaning fabric 13 to clean a cylinder 100. A mounting assembly 80 is affixed to the printing and supports the assembly 1. Mounting assembly 80 may be a unitary structure. Alternatively, mounting assembly 80 may comprise several discrete pieces which are individually used to attach elements of the assembly 1 to the printing press. In yet a third embodiment, the mounting assembly 80 comprises those elements of a printing press which support elements of the assembly 1.

Figure 7:
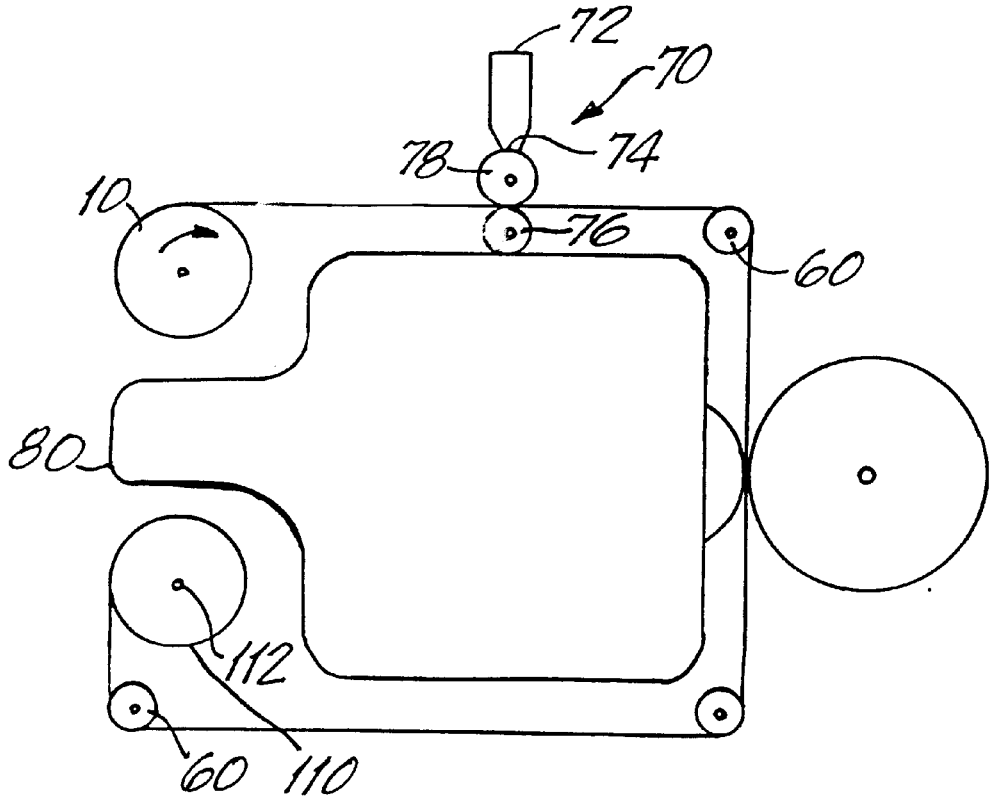
FIG. 7 is a cross-sectional view of an alternate embodiment of an on press highly viscous cleaning agent application system utilizing an application roller.

Cleaning fabric supply roll 10 is preferably rotatably mounted to mounting assembly 1. The strip of cleaning fabric 13 is at least partially removed from the cleaning cloth supply roll 10. A cleaning agent application system 50 is used to apply a measured amount of highly viscous cleaning agent 20 to the strip of cleaning fabric 13. This cleaning agent application system 50 may be the same as that described above regarding FIG. 4. Alternatively, as shown in FIG. 7, an alternate cleaning agent application system 70, such as the one described above regarding the system shown in FIG. 5, may be used. Alternatively, any other application system which applies sufficient amount of highly viscous cleaning agent 20 to the strip of cleaning fabric 13 so that the strip of cleaning fabric 13 is functional for cleaning the cylinder 100 of the printing press.

Figure 2F:
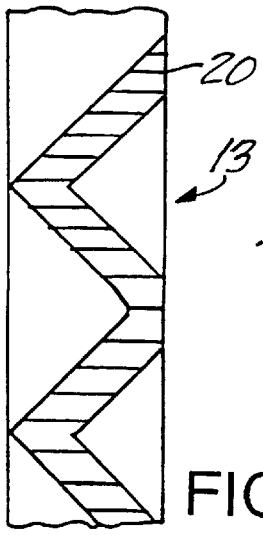
FIG. 2F is a view of s strip of cleaning fabric wherein the highly viscous cleaning agent is placed on the strip of cleaning fabric in alternating diagonal stripes.
Figure 8:
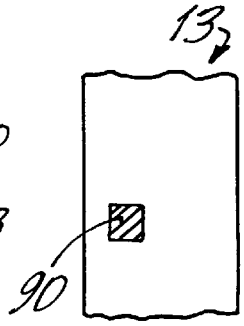
FIG. 8 is a flat view of a strip of cleaning fabric showing a possible size of a dispenser portion of a cleaning agent application assembly in relation to the strip of cleaning fabric.

Additionally, a controller means can be attached to any cleaning agent application system, such as cleaning agent application system 50 or alternate cleaning agent application system 70, used either with an assembly on a printing press (such as shown in FIGS. 6 and 7) or an off press assembly (such as shown in FIGS. 4 and 5). This controller means is used to control the cleaning agent application assembly to place the highly viscous cleaning agent 20 on the strip of cleaning fabric 13 in patterns, such as those shown in FIGS. 2B–2E. This can be achieved in many ways. For example, controller means can act to open and/or close valves to limit the cleaning agent application system from dispensing highly viscous cleaning agent 20 to the strip of cleaning fabric 13. Alternatively, the controller means may act to move the cleaning agent application assembly so that it is not always in contact with the strip of cleaning fabric 13. Such a controller means might create a pattern such as is shown in FIG. 2B. Alternatively, if the cleaning agent application assembly dispenses the highly viscous cleaning agent in segments less than the width of the strip of the cleaning fabric 13, such as shown in FIG. 8 (which shows a dispenser portion 90 of a cleaning agent application assembly in relation to a strip of cleaning fabric 13), the controller would cause the cleaning agent application assembly to move from left to right and back across the width of the strip of cleaning fabric 13. This may create noncontiguous diagonal stripes such as shown in FIG. 2C. This is achieved by only having the cleaning agent application assembly in contact and applying highly viscous cleaning agent 20 only as the assembly moves in one direction. Alternatively, if the cleaning agent application assembly is always kept in contact and applying cleaning agent to the strip of cleaning fabric 13, then contiguous diagonal stripes, such as those shown in FIG. 2F, may be created.

A fabric placer or cylinder cleaning means is used to bring the strip of cleaning fabric 13 in contact with a cylinder 100 to be cleaned and cause the cylinder 100 to be cleaned. Examples of cylinder cleaning means can be found in U.S. patent application Ser. No. 07/955,194 filed on Oct. 2, 1992 by Harold W. Gegenheimer et al. entitled "AUTOMATIC CLEANING SYSTEM FOR PRESS ROLLERS AND CYLINDERS", U.S. Pat. No. 4,867,064 issued Sep. 19, 1989 to Akira Hara et al., entitled "APPARATUS FOR CLEANING A PRINTING CYLINDER", and U.S. Pat. No. 5,150,653 issued Sep. 29, 1992 to Akira Hara entitled "METHOD OF AND APPARATUS FOR CLEANING A CYLINDER", all of which are hereby incorporated by reference. Additionally, any of the above described cylinder cleaning devices can be used with cleaning fabric supply roll 10 which is applied with a highly viscous cleaning agent 20 not on a printing press, such as, but not limited to, when the assemblies shown in FIGS. 4 and 5 are used.

After being used to clean cylinder 100, the used portion of the strip of cleaning fabric 13 is taken up by a take-up means 110. Preferably, take-up means 110 is a take-up shaft 112 rotatably mounted to mounting assembly 80. A take-up roll is formed by winding the used strip of cleaning fabric 13 around the take-up shaft 112. Examples of take-up shaft 72 can be found in a patent application filed by applicant C. Robert Gasparrini on May 1, 1995 entitled "MOUNTING MECHANISMS FOR CLOTH ROLLS ON PRESS CYLINDER CLEANING DEVICES".

A distinct advantage of the cleaning system of this invention is that it eliminates the need for complex apparatus, such as pumps, spray bars, manifold lines, valves and the like, especially as part of the automatic blanket cleaning systems used on printing machinery to introduce cleansing solvents or solutions to the cleaning fabric just prior to use.

In addition, the cleaning system of this invention provides numerous other advantages. For example, it is relatively simple in construction, employs readily available materials, and can be made in a relatively simple and forward manner without resort to highly complex and expensive procedures which necessitate the use of elaborate machinery. Additionally, the invention is preferable to the invention discussed in U.S. Pat. No. 5,368,157 to Gasparrini et al. in that it provides for less solvent displacement during storage and thus less of a change in the fabric roll's center of gravity. Numerous other advantages of this invention will be readily apparent to those skilled in the art.

It will remain understood by those skilled in the art that the present invention in its broader aspects is not limited to the particular embodiments shown and described herein, and that variations may be made which are within the scope of the accompanying claims without departing from the principles of the invention and without sacrificing its chief advantages.

We claim:

1. A device for cleaning a cylinder of a printing press comprising:

a center piece;

a strip of cleaning fabric wrapped around said center piece to form a cleaning fabric supply roll;

a highly viscous cleaning agent present on said cleaning fabric whereby said strip of cleaning fabric is functional for cleaning said cylinder of a printing press, wherein said highly viscous cleaning agent is present on substantially only one side of said strip of cleaning fabric.

2. The device for cleaning the cylinder of a printing press as defined in claim 1 further comprising a means for locating said fabric adjacent to and operatively associated with said cylinder to be cleaned.

3. The device for cleaning a cylinder of a printing press as defined in claim 1 further comprising a mounting means for mounting said center piece and said strip of a cleaning fabric in a position to clean said cylinder while said fabric is in contact with and is fed past said cylinder.

4. The device for claim 1 wherein said highly viscous cleaning agent is a non-Newtonian fluid.

5. The device of claim 1 wherein said highly viscous cleaning agent as present on said strip of cleaning fabric in non-contiguous stripes.

6. A device for cleaning a cylinder of a printing press comprising:

a center piece;

a strip of cleaning fabric wrapped around said center piece to form a cleaning fabric supply roll;

a highly viscous cleaning agent present on said cleaning fabric whereby said strip of cleaning fabric is functional for cleaning said cylinder of a printing press, wherein said highly viscous cleaning agent is present on said strip of cleaning fabric in noncontiguous stripes.

7. The device for cleaning the cylinder of a printing press as defined in claim 6 wherein said stripes are horizontally located across the width of the strip of cleaning fabric.

8. A device for cleaning the cylinder of a printing press as defined in claim 6 wherein said highly viscous cleaning agent is present on said strip of cleaning fabric in diagonal stripes.

9. The device of claim 6, wherein said highly viscous cleaning agent is a non-Newtonian fluid.

10. A device for cleaning a cylinder of a printing press comprising:

a center piece;

a strip of cleaning fabric wrapped around said center piece to form a cleaning fabric supply roll;

a highly viscous cleaning agent present on said cleaning fabric whereby said strip of cleaning fabric is functional for cleaning said cylinder of a printing press, wherein said strip of cleaning fabric is a reduced air content fabric, said reduced air fabric being at least about 25% greater in length than a length of non-air reduced fabric having an equal diameter about said center piece.

11. The device of claim 10 wherein said highly viscous cleaning agent as a non-Newtonian fluid.

12. The device of claim 10 wherein said highly viscous cleaning agent is present on only one side of said strip of cleaning fabric.

13. The device of claim 10 wherein said highly viscous cleaning agent is present on said cleaning fabric in non-contiguous stripes.

14. A method for making a cleaning system comprising:

applying a highly viscous cleaning agent on a strip of cleaning fabric so that said strip of cleaning fabric is functional for cleaning a cylinder of a printing press; and wrapping said strip of cleaning fabric around a center piece to form a cleaning fabric supply roll, wherein said highly viscous cleaning agent is placed on said strip of cleaning fabric in non-contiguous stripes.

15. The method for making a cleaning system as defined by claim 14 wherein said stripes are place substantially across the width of said strip of cleaning fabric.

16. The method for making a cleaning system as defined by claim 14 wherein said highly viscous cleaning agent is placed on said strip of cleaning fabric in substantially diagonal stripes.

17. The method for making a cleaning system as defined by claim 14 further comprising the step of calendaring said strip of cleaning fabric prior to said application step.

18. The method of claim 14 wherein said highly viscous cleaning agent is a non-Newtonian fluid.

19. A method for making a cleaning system comprising:

applying a highly viscous cleaning agent on a strip of cleaning fabric so that said strip of cleaning fabric is functional for cleaning a cylinder of a printing press;

wrapping said strip of cleaning fabric around a center piece to form a cleaning fabric supply roll; and disposing a sealable bag around the cleaning fabric supply roll.

20. The method of claim 19 wherein said highly viscous cleaning agent is a non-Newtonian fluid.

21. A device for cleaning a cylinder of a printing press comprising:

a center piece;

a strip of cleaning fabric wrapped around said center piece to form a cleaning fabric supply roll;

a highly viscous cleaning agent present on said cleaning fabric whereby said strip of cleaning fabric is functional for cleaning said cylinder of a printing press, wherein the highly viscous cleaning agent is a non-Newtonian fluid.

22. The device of claim 21 wherein said highly viscous cleaning agent is present on only one side of said strip of cleaning fabric.

23. The device of claim 21 wherein said highly viscous cleaning agent is present on said cleaning fabric in non-contiguous stripes.

* * * * *